US008500052B2

(12) United States Patent
Helm

(10) Patent No.: US 8,500,052 B2
(45) Date of Patent: Aug. 6, 2013

(54) ROLLER MILL FOR GRINDING PARTICULATE MATERIAL

(75) Inventor: Alexander Helm, Allerod (DK)

(73) Assignee: FLSmidth A/S, Valby (DK)

( * ) Notice: Subject to any disclaimer, the term of this patent is extended or adjusted under 35 U.S.C. 154(b) by 328 days.

(21) Appl. No.: 13/128,708

(22) PCT Filed: Nov. 2, 2009

(86) PCT No.: PCT/IB2009/054862

§ 371 (c)(1), (2), (4) Date: May 11, 2011

(87) PCT Pub. No.: WO2010/061304

PCT Pub. Date: Jun. 3, 2010

(65) Prior Publication Data

US 2011/0215180 A1 Sep. 8, 2011

(30) Foreign Application Priority Data

Nov. 26, 2008 (DK) ..... 2008 01662

(51) Int. Cl.
*B02C 15/00* (2006.01)

(52) U.S. Cl.
USPC ..... 241/121

(58) Field of Classification Search
USPC ..... 241/117–121
See application file for complete search history.

(56) References Cited

U.S. PATENT DOCUMENTS 7,967,228 B2 * 6/2011 Hanghoj et al. ..... 241/121

FOREIGN PATENT DOCUMENTS

GB 2004953 A 4/1979
WO 2009000577 A1 12/2008

OTHER PUBLICATIONS

Written Opinion of the International Searching Authority of Application PCT/IB2009/054862.
International Search Report for PCT/IB2009/054862 dated Mar. 23, 2010.

* cited by examiner

*Primary Examiner* — Mark Rosenbaum
(74) *Attorney, Agent, or Firm* — Buchanan Ingersoll & Rooney PC

(57) ABSTRACT

A roller mill includes a substantially horizontal grinding table, at least one roller operating interactively therewith which is configured for rotation about its centerline by means of a roller bearing and being connected to a roller shaft. The roller mill also includes a force device for at least partial absorption of an axial force originating at least from the roller and acting in the longitudinal direction of the roller shaft. The force device comprises a first part mounted on a machine component which is stationary relative to the longitudinal direction of the roller shaft and a second part mounted on a machine component rotating about the centerline of the roller and co-rotating therewith. The first and second parts comprise opposing pressure surfaces which both extend substantially perpendicular to the longitudinal direction of the roller shaft and form between them a compartment. The pressure surface on the first part is oriented in the opposite direction to the axial force acting in the longitudinal direction of the roller shaft and the pressure surface on the second part is oriented in the same direction as the axial force acting in the longitudinal direction of the roller shaft. An apparatus configured to introduce a pressurized viscous medium into the compartment between the opposing pressure surfaces is also included.

20 Claims, 1 Drawing Sheet

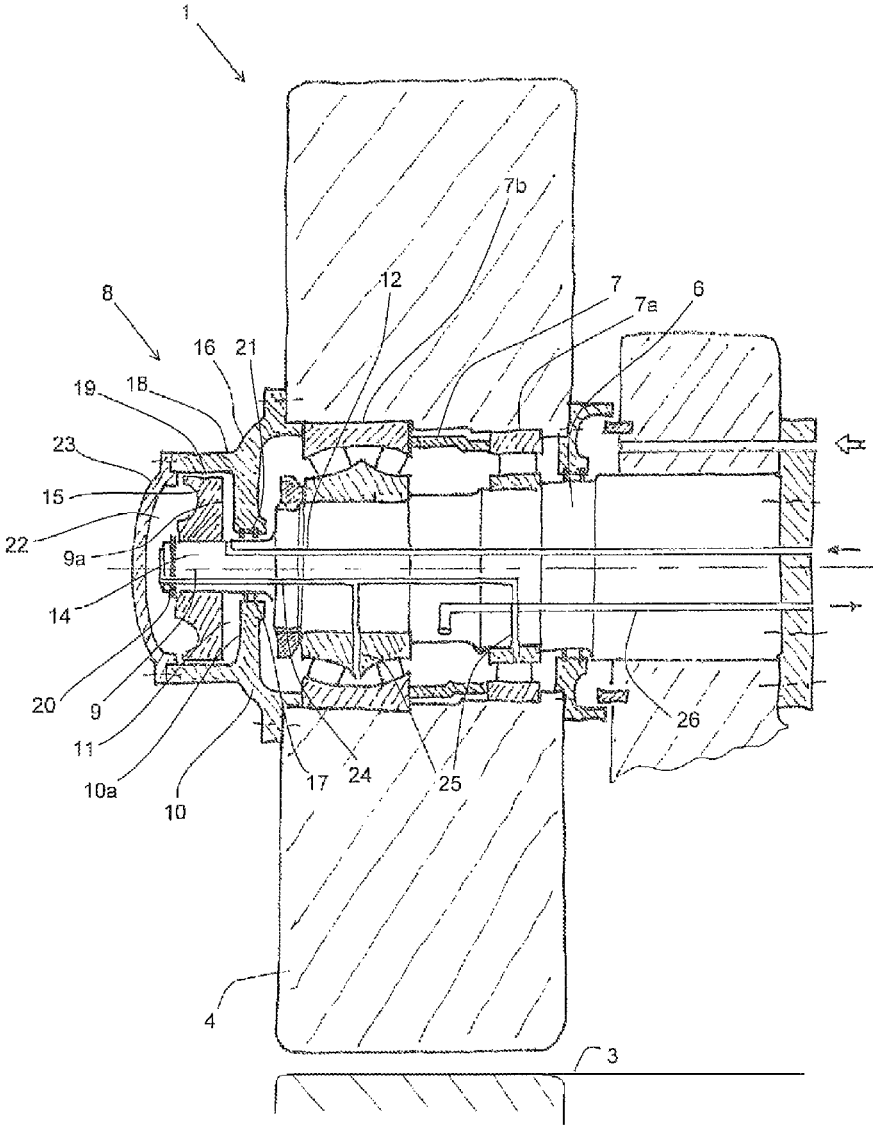
1
7b
12
7
7a
6
8
16
21
19
18
23
15
22
9a
14
20
9
11
10a
10
17
24
25
26
4
3

ROLLER MILL FOR GRINDING PARTICULATE MATERIAL

CROSS REFERENCE TO RELATED APPLICATION

This application is the United States national stage under 35 U.S.C. §371 of International Application No. PCT/IB2009/054862, filed on Nov. 2, 2009, which claimed priority to Danish Patent Application No. PA 2008 01662 26, filed on Nov. 26, 2008. The entirety of these applications is incorporated by reference herein.

FIELD OF THE INVENTION

The present invention relates to a roller mill for grinding particulate material such as cement raw materials, cement clinker and similar materials, said roller mill comprising a substantially horizontal grinding table, at least one roller operating interactively therewith which is configured for rotation about its centerline by means of a roller bearing and being connected with a roller shaft.

BACKGROUND OF THE INVENTION

Roller mills of the aforementioned kind are generally known. In connection with the operation of such kind of roller mill, the roller bearing is subjected to an outwardly directed axial force which is normally absorbed for example by forming the roller bearing as a spherical rolling bearing. However, for some mill configurations the axial force may be so substantial as to prevent the utilization of ordinary types of rolling bearings. This problem is particularly pronounced in large roller mills and particularly in roller mills where the roller or rollers rotate about a vertical central axis since this means that the centrifugal force will contribute quite substantially to the axial force which in such roller mills may be more than tenfold greater than that occurring in roller mills in which there is no rotation of the roller or rollers about such a vertical central axis.

SUMMARY OF THE INVENTION

It is the purpose of the present invention to provide a roller mill by means of which the aforesaid disadvantage is eliminated or significantly reduced.

This is obtained by a roller mill of the kind mentioned in the introduction and being characterized in that it comprises a force device for at least partial absorption of an axial force originating at least from the roller and acting in the longitudinal direction of the roller shaft, said force device comprising a first part which is mounted on a machine component which is stationary relative to the longitudinal direction of the roller shaft, and a second part which is mounted on a machine component rotating about the centerline of the roller and co-rotating therewith, where the first and second part comprise opposing pressure surfaces which both extend substantially perpendicular to the longitudinal direction of the roller shaft, and forming between them a compartment where the pressure surface on the first part is provided so that it is oriented in the opposite direction to the axial force acting in the longitudinal direction of the roller shaft and the pressure surface on the second part is provided so that it is oriented in the same direction as the axial force acting in the longitudinal direction of the roller shaft, and a mechanism, device, or apparatus configured to introduce a pressurized viscous medium into the compartment between the opposing pressure surfaces.

An efficient and adjustable force device for relieving the axial force exerted on the roller bearing which may thus be constituted by commercially available bearings may thus be obtained. The reason for this is that the introduction of a viscous medium, such as oil, into the compartment will result in a pressure build-up in this compartment which may be so adapted to the relevant axial force and pressure surface area, that the roller bearing is relieved completely or partially in the axial direction.

The force device may in principle be configured in any suitable manner. Thus in a simple embodiment the pressure surfaces of the force device may consist of two plane disc-shaped surfaces where, for example, the oil is introduced centrally and discharged at the peripheral gap. However, it is preferred that the force device is formed as a piston in a cylinder so as to allow the two pressure surfaces to migrate relative to one another without influencing the oil pressure in the compartment. In principle it is of secondary importance which of the two parts of the force device constitutes the piston and the cylinder, respectively.

The first part of the force device may in principle be mounted on any machine component which is stationary in the longitudinal direction of the roller shaft. In embodiments of the roller mill in which the roller shaft is stationary and the roller rotates about the latter, it is preferred, however, that the first part is mounted on the roller shaft. Likewise, the second part of the force device may in principle be mounted on any machine component rotating about the centerline of the roller together with the roller. However, it is preferred that the second part is mounted on the roller.

In a preferred embodiment of the force device the first part comprises a shaft journal protruding axially from the roller shaft and comprising at its extreme free end a piston section with an inwardly orienting pressure surface, and the second part comprises an inner cover part with an outwardly orienting pressure surface, said cover part being formed with a central hole for lead-through of the shaft journal of the first part and an outwardly orienting cylinder section encompassing the piston section of the first part. In such an embodiment a gap will exist between the peripheral edge of the piston section and the inner wall of the cylinder section, the size of which gap will be a co-determinant of the pressure which can be built up in the compartment between the two pressure surfaces in order to relieve the axial force on the roller bearing.

The piston section on the shaft journal of the first part may be integrally formed with the shaft journal which in turn may be integrally formed with the roller shaft or it may be a part which is mounted on the roller shaft. The piston section may also take the form of a ring-shaped disc which is firmly attached to the shaft journal for example through shrinkage and/or by means of a locking ring.

The central hole in the cover part of the second part may be provided with a number of oil sealing rings to prevent or restrict the amount of oil passing through the hole. Alternatively, a gap may be formed between the central hole and the shaft journal which is led through the hole to allow a smaller amount of oil to pass into an oil sump, where appropriate, at the roller bearing.

The viscous medium, such as oil, may be introduced into the compartment between the two opposing pressure surfaces in any suitable manner. For instance, oil may be introduced into the compartment via one or several through-going openings in the pressure surface of the first part. However, it is preferred that the oil be fed to the compartment via at least one duct provided in the roller shaft and the shaft journal and terminating in the compartment.

The oil or other viscous medium which is discharged from the compartment between the two pressure surfaces may in a simple embodiment be collected in a vessel which is located below the compartment. However it is preferred that oil be discharged from the compartment via the gap between the piston section of the first part and the cylinder section of the second part and be collected in a chamber which is bounded by the outer side of the piston section of the first part and a lid which is attached at the extreme end of the cylinder section of the second part. In the latter embodiment the collected oil may be returned from the chamber via a duct provided in the roller shaft and the shaft journal. The returned oil may either be directed directly to an oil tank for possible recycling or via a number of ducts in the roller shaft it may be directed to the roller bearing for lubrication hereof, and from there be directed onward to the oil tank via a further duct in the roller shaft.

Other details, objects, and advantages of the invention will become apparent as the following description of certain present preferred embodiments thereof and certain present preferred methods of practicing the same proceeds.

BRIEF DESCRIPTION OF THE DRAWINGS

The invention will now be explained in further details with reference to the FIGURE, which is a diagrammatical drawing showing a sectional view of an embodiment of the roller mill according to the invention.

DETAILED DESCRIPTION OF PRESENT PREFERRED EMBODIMENTS

The FIGURE illustrates an embodiment of a roller mill 1 according to the invention which comprises a horizontal grinding table 3 and a roller 4 operating interactively therewith. The roller 4 rotates about a roller shaft 6 by means of a roller bearing 7 which in the shown embodiment is constituted by a radial rolling bearing 7*a* and a spherical rolling bearing 7*b*. The roller bearing itself 7 is not part of the present invention and may be differently configured, for example incorporating a slide bearing.

In order to obtain an efficient and adjustable force device for relieving the axial force on the roller bearing 7 to allow the latter to be constituted by a commercially available bearing, the roller mill according to the invention comprises a force device 8 which comprises a first part 9 which is mounted on the roller shaft 6, and a second part 10 which is mounted on the roller 4, and co-rotating with the latter. The first part 9 and the second part 10 comprise opposing pressure surfaces 9*a*, 10*a*, both extending substantially perpendicular to the longitudinal direction of the roller shaft 6. Between them the two pressure surfaces 9*a* and 10*a* form a compartment 11 in which the pressure surface 9*a* on the first part 9 is provided at the extreme end and facing inwards towards the roller 4 and the pressure surface 10*a* on the second part 10 is provided in innermost position and facing outwards away from the roller 4. The roller mill further comprises an apparatus 12 for introducing pressurized oil to the compartment 11 between the opposing pressure surfaces 9*a*, 10*a*. By introducing oil into the compartment 11 it will be possible to build up a pressure in this compartment 11 which is so adapted to the relevant axial force and pressure surface area, that the roller bearing 7 is relieved completely or partially.

In the shown preferred embodiment of the force device 8, the first part 9 comprises a shaft journal 14 which protrudes axially from the roller shaft 6, and a piston section 15 with an inwardly facing pressure surface 9*a*, whereas the second part 10 comprises an inner cover part 16 with an outwardly facing pressure surface 10*a* and a central hole 17 for lead-through of the shaft journal 14 and an outwardly orienting cylinder section 18 encompassing the piston section 15. A gap 19 exists between the peripheral edge of the piston section 15 and the inner wall of the cylinder section 18. The gap 19 is a co-determinant of the pressure which can be built up in the compartment 11 in order to relieve the axial force on the roller bearing.

As illustrated in the FIGURE, the piston section 15 consists of a ring-shaped disc which is firmly attached to the shaft journal 14 by means of a locking ring 20.

The central hole 17 in the cover part 16 is in the shown embodiment provided with a couple of oil sealing rings 21 in order to reduce the amount of oil passing through the hole 17.

The oil is introduced, as shown, into the compartment 11 via a duct 12 provided in the roller shaft 6 and the shaft journal 14 and terminating in the compartment 11.

In the shown embodiment the oil is discharged from the compartment 11 via the gap 19 between the piston section 15 and the cylinder section 18 and it is collected in a chamber 22 which is bounded by the outer side of the piston section 15 and a lid 23 which is fixed at the extreme end of the cylinder section 18 of the second part. From here the collected oil is directed via a duct 24 and a number of ducts 25 in the roller shaft 6 to the roller bearing 7 for lubrication hereof prior to being directed via a further duct 26 in the roller shaft 6 to an oil tank, not shown, for possible recycling.

Embodiments of the roller mill may utilize an efficient and adjustable force device for relieving the axial force exerted on the roller bearing which may thus be constituted by commercially available bearings. The reason for this is that the introduction of a viscous medium, such as oil, into the compartment will result in a pressure build-up in this compartment which may be so adapted to the relevant axial force and pressure surface area, that the roller bearing is relieved completely or partially in the axial direction.

While certain present preferred embodiments of the roller mill and certain embodiments of methods of practicing the same have been shown and described, it is to be distinctly understood that the invention is not limited thereto but may be otherwise variously embodied and practiced within the scope of the following claims.

The invention claimed is:

1. A roller mill comprising a substantially horizontal grinding table;

at least one roller configured for rotation via a roller bearing;

a roller shaft connected to the at least one roller;

a force device for at least partial absorption of an axial force originating at least from the at least one roller and acting in the longitudinal direction of the roller shaft, the force device comprising a first part mounted on a machine component which is stationary relative to a longitudinal direction of the roller shaft and a second part mounted on a machine component rotating about the at least one roller and co-rotating therewith; and the first and second part comprising opposing pressure surfaces which both extend substantially perpendicular to the longitudinal direction of the roller shaft and forming between them a compartment where the pressure surface of the first part is oriented in a direction opposite to the axial force acting in the longitudinal direction of the roller shaft and the pressure surface of the second part oriented in the same direction as the axial force acting in the longitudinal direction of the roller shaft; and an apparatus that introduces a pressurized viscous medium into the compartment.

2. The roller mill of claim 1 wherein the force device is formed as a piston in a cylinder.

3. The roller mill of claim 1 wherein the first part of the force device is mounted on the roller shaft and the second part is mounted on the at least one roller.

4. The roller mill of claim 1 wherein the first part of the force device comprises a shaft journal protruding axially from the roller shaft and comprises a piston section with an inwardly orienting pressure surface at a free distal end of the first part and wherein the second part of the force device comprises an inner cover part with an outwardly orienting pressure surface, said inner cover part being formed with a central hole for lead-through of the shaft journal of the first part and an outwardly orienting cylinder section encompassing the piston section of the first part.

5. The roller mill of claim 4 wherein a gap is defined between a peripheral edge of the piston section and an inner wall of the cylinder section.

6. The roller mill of claim 5 wherein the viscous medium is discharged from the compartment via the gap and is collected in a chamber bounded by the outer side of the piston section of the first part and a lid attached at an end of the cylinder section of the second part.

7. The roller mill of claim 6 wherein the viscous medium is returned from the chamber via one of a conduit and a duct provided in the roller shaft and the shaft journal.

8. The roller mill of claim 6 wherein the viscous medium is returned via a number of ducts in the roller shaft directed to the roller bearing and from the roller bearing is directed onward through a further duct in the roller.

9. The roller mill of claim 4 wherein the piston section is comprised of a ring-shaped disc which is firmly attached to the shaft journal through shrinkage and/or via a locking ring.

10. The roller mill of claim 4 wherein the central hole in the cover part of the second part is provided with a number of oil sealing rings.

11. The roller mill of claim 4 wherein the apparatus comprises at least one duct in the roller shaft and the viscous medium is supplied to the compartment via the at least one duct in the roller shaft and the shaft journal, the shaft journal terminating in the compartment.

12. A roller mill comprising:

a grinding table;

at least one roller comprising a first roller;

at least one roller bearing comprising a first roller bearing;

a roller shaft connected to the first roller via the first roller bearing such that the first roller rotates about the roller shaft adjacent to the grinding table;

a force device having a first part mounted on the roller shaft and a second part mounted on the first roller, the first part having a first pressure surface and the second part having a second pressure surface, the first and second pressure surfaces defining a compartment sized and configured to receive a fluid to relieve an axial force acting on the first roller bearing; and a fluid transport apparatus connected to the force device, the apparatus sized and configured to pass the fluid into the compartment.

13. The roller mill of claim 12 wherein the fluid transport apparatus comprises at least one first conduit connected to the roller shaft and at least one second conduit connected to the roller shaft, the at least one first conduit in communication with the compartment to feed the fluid into the compartment and at least one second conduit in communication with the compartment to receive fluid from the compartment.

14. The roller mill of claim 13 wherein the fluid is oil and wherein the at least one first conduit and the at least one second conduit are positioned in the roller shaft.

15. The roller mill of claim 13 further comprising a tank in communication with the at least one second conduit, the at least one second conduit sized and configured such that the fluid passes from the compartment to the tank.

16. The roller mill of claim 13 wherein the at least one first conduit is a duct and the at least one second conduit is at least one duct.

17. The roller mill of claim 13 wherein the first roller bearing is a radial roller bearing and the at least one roller bearing is further comprised of a second roller bearing, the second roller bearing being a spherical rolling bearing.

18. The roller mill of claim 12 wherein the first part is comprised of a shaft journal protruding from the roller shaft and a piston section defining the first pressure surface and wherein the second part is comprised of an inner cover and a cylinder section, the inner cover defining the second pressure surface, the inner cover having a hole receiving the shaft journal and the cylinder section encompassing the piston section.

19. The roller mill of claim 18 wherein the piston section and the cylinder section are spaced apart to define a gap.

20. The roller mill of claim 19 wherein the fluid transport apparatus comprises at least one first conduit connected to the roller shaft and at least one second conduit connected to the roller shaft, the at least one first conduit in communication with the compartment to feed the fluid into the compartment and at least one second conduit comprising a chamber and at least one duct, the chamber receiving the fluid from the compartment via the gap and the at least one duct receiving the fluid from the chamber.

* * * * *